US007563135B2

(12) United States Patent
Takahashi et al.

(10) Patent No.: US 7,563,135 B2
(45) Date of Patent: Jul. 21, 2009

(54) CONNECTOR

(75) Inventors: Toshiharu Takahashi, Makinohara (JP); Kazuto Ohtaka, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/195,206

(22) Filed: Aug. 20, 2008

(65) Prior Publication Data

US 2009/0053916 A1 Feb. 26, 2009

(30) Foreign Application Priority Data

Aug. 21, 2007 (JP) ..... 2007-214411

(51) Int. Cl.
*H01R 13/40* (2006.01)

(52) U.S. Cl. ..... 439/595; 439/488

(58) Field of Classification Search ..... 439/595, 439/752, 488

See application file for complete search history.

(56) References Cited

U.S. PATENT DOCUMENTS 7,165,993 B2 * 1/2007 Fukamachi et al. ..... 439/595
7,347,745 B1 * 3/2008 Raudenbush et al. ..... 439/752
7,438,594 B2 * 10/2008 Natter ..... 439/595
7,500,887 B2 * 3/2009 Ichio ..... 439/752

FOREIGN PATENT DOCUMENTS

JP 3311228 B2 5/2002

* cited by examiner

*Primary Examiner*—Khiem Nguyen
(74) *Attorney, Agent, or Firm*—Sughrue Mion, PLLC

(57) ABSTRACT

A connector 1 includes a connector housing 2, and a retainer 3. The retainer 3 includes lances 6 which are inserted into respective terminal receiving spaces 21 through respective opening portions 28 to be retainingly engaged respectively with metal terminals 4, and a lance abutment portion 8 which abuts against the lances 6 to hold the lances 6 in retainingly-engaged relation to the respective metal terminals 4. The amount of insertion of the lance 6 in the terminal receiving space 21 before the lance is retainingly engaged with the metal terminal 4 is equal to the amount of insertion of the lance 6 in the terminal receiving space 21 when the lance is retainingly engaged with the metal terminal 4. When the metal terminal 4 is kept half inserted, the lance 6 is located outwardly of the terminal receiving space 21, so that the lance abutment portion 8 is held in a lifted condition, from which it is detected that and the metal terminal 4 is half inserted in the terminal receiving space 21.

3 Claims, 12 Drawing Sheets

CONNECTOR

BACKGROUND OF THE INVENTION

1. Field of the Invention

This invention relates to a connector having a retainer for preventing withdrawal of metal terminals received in a connector housing 2. Description of the Related Art A wire harness is installed in an automobile so as to feed electric power, a control signal, etc., to an electronic equipment mounted on the automobile. The wire harness comprises a plurality of wires, and a connector connected to ends of these wires. This connector comprises electrically-conductive metal terminals connected to the wires, and an insulative connector housing receiving the metal terminals therein, and this connector is connected to a connector of the electronic equipment.

As one example of the above-mentioned connector, there is known a connector 101 (as shown in FIGS. 12 to 14) having a retainer 103 for preventing a metal terminal 104 from being withdrawn from a terminal receiving space 121 of a connector housing 102 (see, for example, Patent Literature 1).

The metal terminal 104 is secured, for example, to an end portion of a wire 105 of a wire harness, and includes an electrical contact portion 141 of a hollow square tubular shape for receiving a mating metal terminal therein, and a wire connection portion 143 for connection to the wire 105.

An opening portion 128 communicating the exterior and interior of the terminal receiving space 121 is formed through an outer wall 120 of the connector housing 102, and the retainer 103 is inserted into the terminal receiving space 121 through this opening portion 128.

The retainer 103 includes a base portion 131, a displacement portion 132 extending from one end portion 131*a* of the base portion 131 and spaced a distance S from the base portion 131, and a retaining portion 133 projecting from a distal end portion 132*b* of the displacement portion 132. Namely, the base portion 131 and the displacement portion 132 jointly assume a generally U-shaped cross-section, and the distal end portion 132*b* of the displacement portion 132 is a free end portion, and can be moved into and out of contact with the other end portion 131*b* of the base portion 131.

In the connector 101 of the above construction, the retainer 103 is inserted lightly into the terminal receiving space 121 through the opening portion 128, with the displacement portion 132 facing downward, and is provisionally retained relative to the connector housing 102. Then, the metal terminal 104 is inserted into the terminal receiving space 121 in the connector housing 102 relative to which the retainer 103 is provisionally retained, as shown in FIG. 12. In this condition shown in FIG. 12, the retaining portion 133 is retainingly engaged lightly with a corner portion 141*a* of the electrical contact portion 141 of the metal terminal 104 to provisionally hold this metal terminal 104 in the terminal receiving space 121.

Then, by pressing the base portion 131, the retainer 103 and hence the displacement portion 132 are inserted deeper into the terminal receiving space 121, and the retaining portion 133 is engaged with the corner portion 141*a* of the electrical contact portion 141 in an amount larger than the amount of engagement obtained in the provisionally-held condition (see FIG. 12), thereby completely retaining or holding the metal terminal 104 against withdrawal from the terminal receiving space 121 as shown in FIG. 13.

When the metal terminal 104 is half inserted in the terminal receiving space 121 as shown in FIG. 14, the displacement portion 132 is held on the electrical contact portion 141, and hence is elastically deformed upward. Therefore, in this half-inserted condition, even when the base portion 131 is pressed, this base portion 131 strikes against the displacement portion 132, and the retainer 103 can not be inserted deeper into the terminal receiving space 121. Therefore, the half-inserted condition of the metal terminal 104 can be detected.

Patent Literature 1: Japanese Patent No. 3,311,228

However, in the connector 101 of the above construction, the engagement of the retaining portion 133 with the metal terminal 104 in the provisionally-held condition (see FIG. 12) is light, that is, the amount of engagement of the retaining portion 133 with the provisionally-held metal terminal 104 is small. Therefore, a terminal retaining force: obtained in this provisionally-held condition was smaller than that obtained in the completely-held condition (see FIG. 13). Therefore, there was a strong possibility that the metal terminal 104 in its provisionally-held condition was withdrawn from the terminal receiving space 121. Furthermore, in the case where the connector 101 is of the small-size type, it was more difficult to secure a sufficient amount of engagement of the retaining portion 133 with the provisionally-held metal terminal 104, and therefore there was a stronger possibility that the metal terminal 104 was withdrawn from the terminal receiving space 121.

Furthermore, in the connector 101 of the above construction, the amount of engagement of the retaining portion 133 with the provisionally-held metal terminal 104 was small, and therefore an insertion feeling obtained when inserting the metal terminal 104 into its proper position is small, and therefore there was a possibility that the metal terminal 104 was not inserted into the proper position, and hence was held in a half-inserted condition.

Furthermore, in the connector 101 of the above construction, the retainer 103 is constructed such that the gap S is formed between the base portion 131 and the displacement portion 132 in the completely-held condition (see FIG. 13). Therefore, there was a possibility that the displacement portion 132 was elastically deformed upward, that is, toward the base portion 131 as when a high impact was applied to the connector 101 in the completely-held condition.

SUMMARY OF THE INVENTION

It is therefore an object of this invention to provide a connector in which a metal terminal is positively prevented from withdrawal from a connector housing.

The above object has been achieved by a connector of a first aspect of the invention comprising a connector housing having a terminal receiving space for receiving a metal terminal, and a retainer for preventing withdrawal of the metal terminal from the terminal receiving space; characterized in that the retainer includes a lance which is inserted into the terminal receiving space through an opening portion formed through an outer wall of the connector housing, and is retainingly engaged with the metal terminal located in a proper position within the terminal receiving space, thereby preventing withdrawal of the metal terminal from the terminal receiving space; and a lance abutment portion which abuts against the lance retainingly engaged with the metal terminal, and is retainingly engaged with a retaining portion formed at the connector housing, thereby holding the lance in retainingly-engaged relation to the metal terminal; and the lance is provided such that the amount of insertion of the lance in the terminal receiving space before the lance is retainingly engaged with the metal terminal is equal to the amount of insertion of the lance in the terminal receiving space when the lance is retainingly engaged with the metal terminal; and when the metal terminal is kept half inserted in the terminal receiving space, the lance is located outwardly of the terminal receiving space, so that the lance prevents the lance abutment portion from being retainingly engaged with the retaining portion, thereby detecting the fact that the metal terminal is half inserted in the terminal receiving space.

The connector of the second aspect of the invention is characterized in that the lance and the lance abutment portion are interconnected by a hinge.

The connector of the third aspect of the invention is characterized in that the lance abutment portion is so provided as to be displaced between a position where the lance abutment portion is spaced from the lance and a position where the lance abutment portion abuts against the lance; and the connector housing has a provisionally-retaining portion with which the lance abutment portion spaced from the lance can be retainingly engaged.

In the invention of the first aspect of the invention, the lance is provided such that the amount of insertion of the lance in the terminal receiving space before the lance is retainingly engaged with the metal terminal is equal to the amount of insertion of the lance in the terminal receiving space when the lance is retainingly engaged with the metal terminal. Therefore, the amount of engagement of the lance with the metal terminal, that is, a retaining force by which the lance retains the metal terminal within the terminal receiving space, is always constant, and therefore there can be provided the connector in which the metal terminal is positively prevented from withdrawal from the connector housing. Furthermore, an insertion feeling, obtained when the metal terminal is inserted into the proper position within the terminal receiving space, can be made large, and therefore the metal terminal is prevented from being kept in a half-inserted condition (in which the metal terminal is not inserted into the proper position). Furthermore, the lance abutment portion abuts against the lance retainingly engaged with the metal terminal, and therefore the retaining engagement of the lance with the metal terminal is prevented from being canceled, and therefore the metal terminal is positively prevented from withdrawal from the connector housing. Furthermore, when the metal terminal is kept half inserted in the terminal receiving space, the lance is located outwardly of the terminal receiving space, so that the lance prevents the lance abutment portion from being retainingly engaged with the retaining portion, thereby detecting the fact that the metal terminal is half inserted in the terminal receiving space. Therefore, the metal terminal is prevented from being kept in a half-inserted condition.

In the second aspect of the invention, the lance and the lance abutment portion are interconnected by the hinge, and therefore the number of the component parts of this connector, as well as the number of molds for producing the connector, can be reduced, and therefore the cost of management for the component parts of the connector, as well as the cost of management for the molds for producing the connector, can be reduced. Furthermore, the time and labor required for assembling the connector can reduced since the number of the connector parts is reduced, and further an operation for arranging the lance and the lance abutment portion in a proper direction relative to each other for assembling purposes and an operation for positioning them relative to each other can be omitted, and therefore the efficiency of the connector assembling operation is enhanced, and therefore a cost required for assembling the connector can be reduced.

In the third aspect of the invention, the connector housing has the provisionally-retaining portion with which the lance abutment portion spaced from the lance can be retainingly engaged. Therefore, the connector can be carried and stored, with the lance abutment portion kept provisionally retained relative to the connector housing.

DESCRIPTION OF THE PREFERRED EMBODIMENTS

One preferred embodiment of a connector of the present invention will now be described with reference to FIGS. 1 to 11.

The connector 1 shown in FIGS. 1 to 11 forms, together with wires, a wire harness to be installed in an automobile or the like, and this connector 1 comprises metal terminals 4, a connector housing 2, and a retainer 3.

Figure 4:
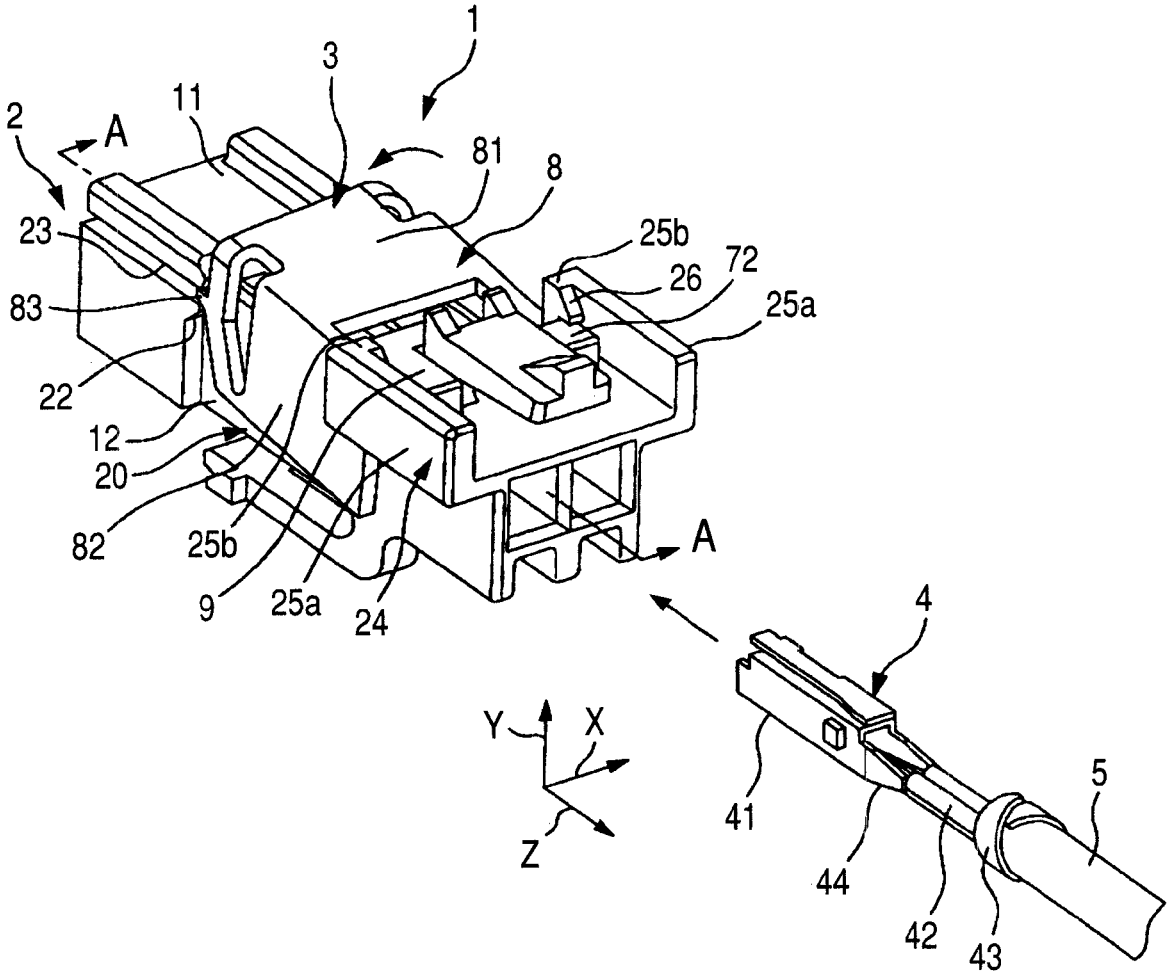
FIG. 4 is a perspective view of the connector, showing a condition in which a lance abutment portion of the retainer is provisionally retained relative to the connector housing of FIG. 3.

As shown in FIG. 4, the metal terminal 4 is formed by bending an electrically-conductive metal sheet, and is secured, for example, to an end portion of the wire 5 of the wire harness. The metal terminal 4 is formed into a generally hollow square tubular shape, and includes an electrical contact portion 41 for receiving a mating metal terminal therein, a conductor connection portion 42 for connection to a conductor of the wire 5, a press-fastening portion 43 formed at one end of the conductor connection portion 42 and adapted to be press-fastened to a sheath of the wire 5, and an interconnecting portion 44 interconnecting the electrical contact portion 41 and the conductor connection portion 42.

In the metal terminal 4, the conductor connection portion 42 is electrically connected to the conductor of the wire 5, and the press-fastening portion 43 is press-fastened to the sheath of the wire 5, and in this condition the metal terminal 4 is inserted into a terminal receiving space 21 of the connector housing 2, with the electrical contact portion 41 first introduced thereinto.

The connector housing 2 is made of an insulative synthetic resin, and includes a body portion 20 of a box-shape formed by a plurality of outer walls 11, 12, 12 and 13, a retainer mounting portion 24 formed on an outer surface of the body portion 20, a pair of provisionally-retaining portion 23, and a pair of retaining portions 22.

Figure 1:
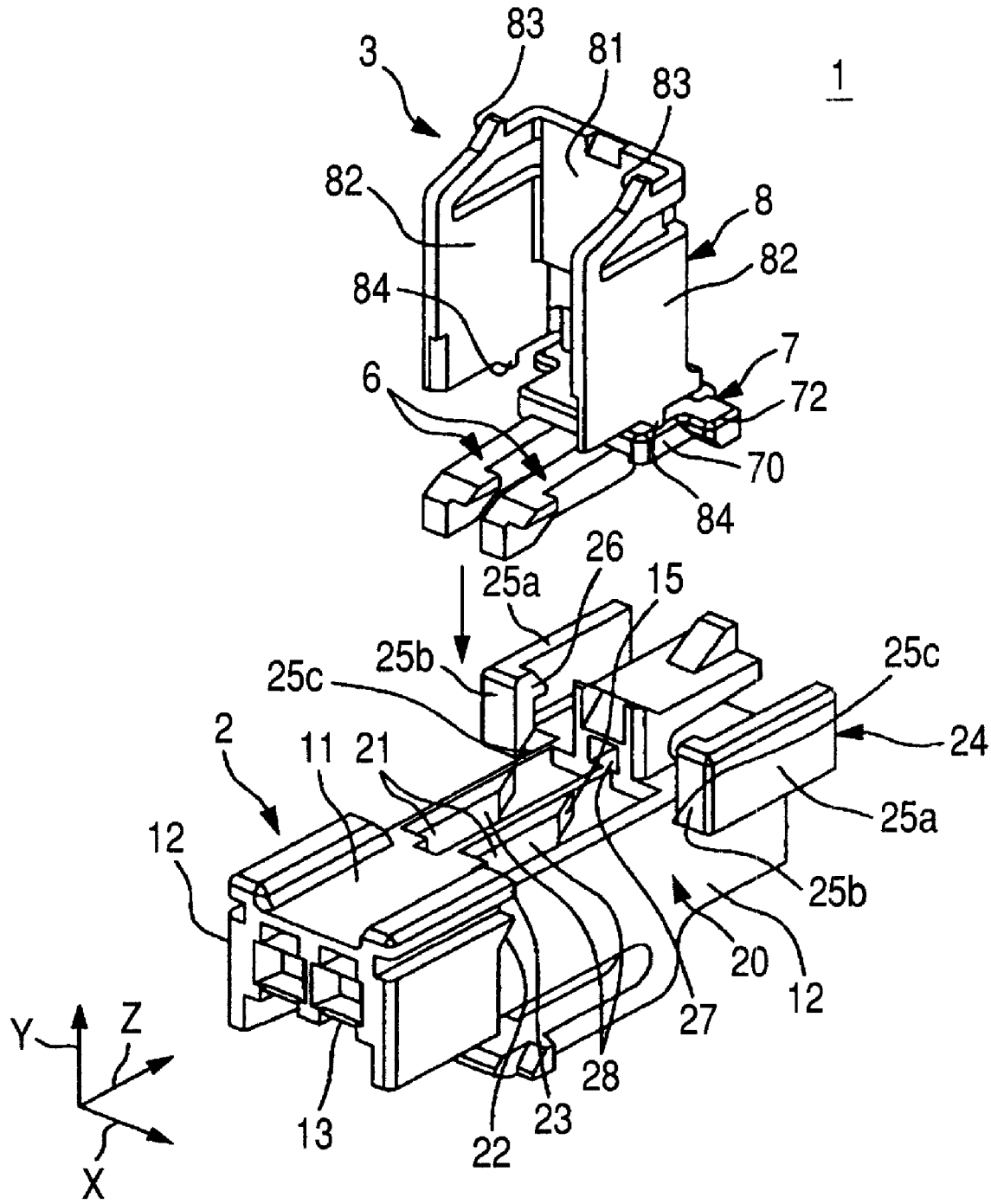
FIG. 1 is a perspective view of one preferred embodiment of a connector of the present invention, showing a condition in which a connector housing and a retainer are separated from each other.

The outer wall 11 extends in a direction X of a width of the connector housing 2 and also in a direction Z of fitting thereof, and is disposed at the upper side in FIG. 1. This outer wall 11 will hereinafter be referred to as "upper wall 11". The pair of outer walls 12 extend in a direction Y of height of the connector housing 2 and also in the fitting direction Z, and are opposed to each other. The outer wall 12 will hereinafter be referred to as "side wall 12". The term "fitting direction Z" means a direction along which the connector housing 2 is moved when it is to be fitted to a mating connector housing. In the present specification, the term "upper side" means the upper side at the sheet of each of FIGS. 1 to 11.

The body portion 20 has a plurality of terminal receiving spaces 21 each for receiving the metal terminal 4 therein. The terminal receiving spaces 21 are formed by the plurality of outer walls 11, 12, 12 and 13 and a partition wall 15 (partitioning the interior of the body portion 20), each terminal receiving space 21 being formed into a tubular shape extending in the fitting direction Z. Namely, opposite end portions 21*a* and 21*b* (see FIG. 8) of the terminal receiving space 21 spaced from each other in the fitting direction Z communicate with the exterior of the connector housing 2. In this embodiment, the body portion 20 has two terminal receiving spaces 21, and the two terminal receiving spaces 21 are juxtaposed to each other in the widthwise direction X. The metal terminal 4 is inserted into the terminal receiving space 21 through one end portion 21*a*, and is moved toward the other end portion 21*b* in the fitting direction Z.

Opening portions 28 are formed through a central portion (in the fitting direction Z) of the upper wall 11, and are disposed in registry with the two terminal receiving spaces 21, respectively, each opening portion 28 communicating the exterior and interior of the corresponding terminal receiving space 21. Lances 6 of the retainer 3 (described later) can be passed through these opening portions 28, respectively.

As shown in FIG. 1, the retainer mounting portion 24 is formed on an upper portion (in the direction Y of the height) of the body portion 20 at one end portion (in the fitting direction Z) thereof, and includes a pair of upstanding walls 25*a*, a pair of extension portions 25*b*, a pair of projections 26, and a retainer mounting recess 27.

The pair of upstanding walls 25*a* are connected respectively with upper edges (in the direction Y of the height) of one end portions (in the fitting direction Z) of the pair of side walls 12, and extend upwardly in the direction Y of the height in opposed relation to each other. The pair of extension portions 25*b* are formed respectively on those ends of the pair of upstanding walls 25*a* disposed near to the opening portions 28, and extend toward each other, and are spaced from each other. The pair of projections 26 are formed on the pair of extension portions 25*b*, respectively, and project away from the opening portions 28. The retainer mounting recess 27 is a concavely-recessed portion, and is provided between the pair of extension portions 25*b*, and is open toward the opening portions 28, and extends in the fitting direction Z. A base portion 7 of the retainer 3 (described later) is releasably attached to the retainer mounting portion 24.

The pair of provisionally-retaining portions 23 project respectively from opposite side portions (spaced from each other in the widthwise direction X) of that end portion of the upper wall 11 remote from the retainer mounting portion 24. When a lance abutment portion 8 is provisionally retained relative to the connector housing 2, first retaining projections 83 (described later) are retainingly engaged with the provisionally-retaining portions 23, respectively.

The pair of retaining portions 22 are formed respectively at the other end portions (in the fitting direction Z) of the opposed side walls 12. The other end portions of the opposed side walls 12 project outwardly (in the direction X of the height) respectively beyond the central portions thereof and also respectively beyond the one end portions thereof. The pair of retaining portions 22 are formed respectively at end faces of these projected end portions, and project in the fitting direction Z toward the one end portion of the body portion 20. The pair of retaining portions 22 are spaced respectively from the pair of provisionally-retaining portions 23 in the direction Y of the height. The pair of retaining portions 22 are disposed below the pair of provisionally-retaining portions 23, respectively. When the lance abutment portion 8 is completely retained relative to the connector housing 2, the first retaining projections 83 (described later) are retainingly engaged with the retaining portions 22, respectively.

The retainer 3 is made of an insulative synthetic resin, and includes the base portion 7 for being attached to the retainer mounting portion 24, the pair of lances 6 formed integrally with the base portion 7 and extending in the fitting direction Z, and the lance abutment portion 8 connected to the base portion 7 through a pair of hinges 9.

The base portion 7 includes a U-shaped portion 70 (having a U-shape when viewed from the top), a first projecting portion 71 projecting from a central portion (in the widthwise direction X) of the U-shaped portion 70, and second projecting portions 72 projecting respectively from opposite side edges of the U-shaped portion 70 away from each other. The base portion 7 has a flat bottom surface for abutting against the upper surface of the upper wall 11.

As shown in FIG. 1, the base portion 7 is moved toward the connector housing 2 from the upper side thereof in the direction Y of the height, and is press-fitted to the retainer mounting portion 24. Namely, when the base portion 7 is attached to the retainer mounting portion 24 (and hence connector housing 2), the first projecting portion 71 is fitted in the retainer mounting recess 27, and the pair of second projecting portions 72 are located respectively at the inner sides of the pair of upstanding walls 25*a* such that each second projecting portion 72 is disposed between the corresponding projection 26 and the upper wall 11.

The pair of lances 6 are integrally connected with a central portion (in the widthwise direction X) of the base portion 7. When the base portion 7 is attached to the retainer mounting portion 24 as described above, the pair of lances 6 are passed through the respective opening portions 28 and are inserted into the respective terminal receiving spaces 21.

The pair of lances 6 each having a generally quadrangular prism-shape are provided in parallel spaced relation to each other. The pair of lances 6 are integrally formed at their one ends (in the longitudinal direction) on the outer surface of the central portion of the base portion 7. The pair of lances 6 are slanting downwardly relative to the base portion 7 from the one ends thereof toward the other ends thereof in the longitudinal direction. A dimension (width) of each lance 6 in the widthwise direction X is slightly smaller than a dimension (width) of the terminal receiving space 21 in the widthwise direction X. The pair of lances 6 are inserted into the respective terminal receiving spaces 21 from the exterior of the connector housing 2 through the respective opening portions 28.

The other end portions of the pair of lances 6 remote from the base portion 7 abut respectively against the interconnecting portions 44 of the metal terminals 4 received respectively in the terminal receiving spaces 21, and hold these interconnecting portions 44 toward the outer wall 13. This outer wall 13 is disposed in opposed relation to the upper wall 11, and is located at the lower side in FIG. 8.

When the metal terminal 4 is thus received in the terminal receiving space 21, an upper surface of the electrical contact portion 41 is disposed closer to the upper wall 11 than an upper surface of the interconnecting portion 33 is. Therefore, when the metal terminal 4 is located in a proper position within the terminal receiving space 21, with the lance 5 abutting against the interconnecting portion 44, the movement of the electrical contact portion 41 in the fitting direction Z within the terminal receiving space 21 is blocked by the lance 6. Thus, the metal terminal 4 is prevented from moving in the direction Y of the height and the fitting direction Z, and therefore is prevented from withdrawal from the terminal receiving space 21.

Figure 11:
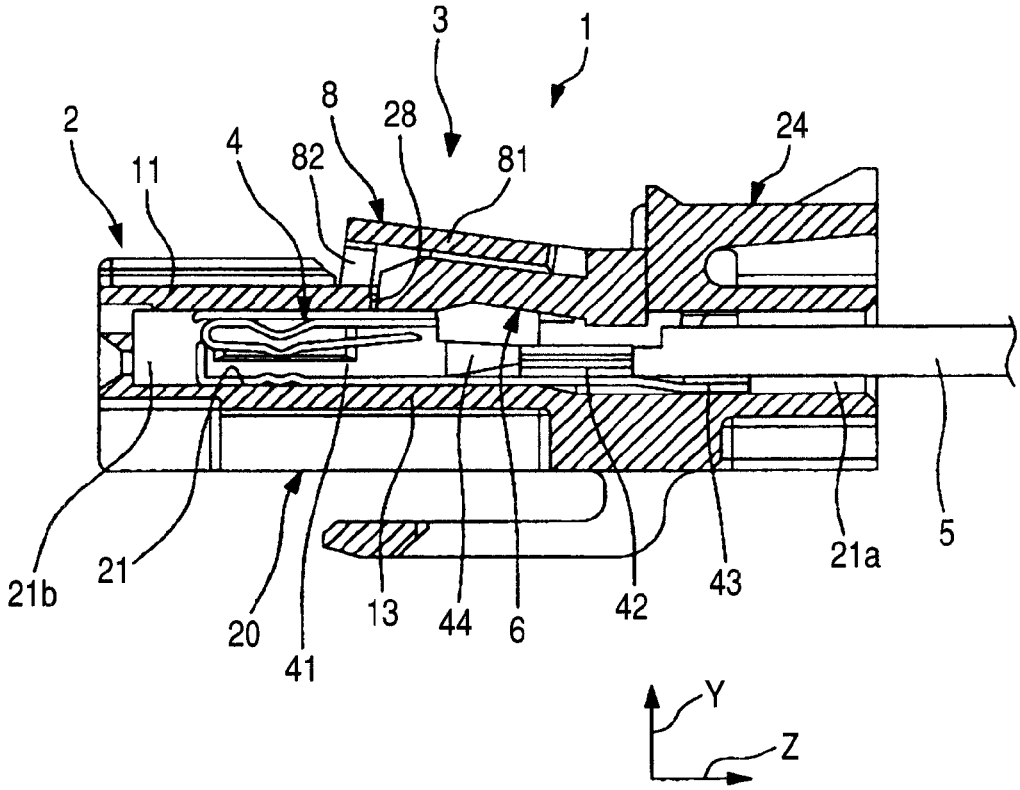
FIG. 11 is a cross-sectional view of the connector of FIG. 1, showing a condition in which the metal terminal is half inserted in the connector housing.
Figure 12:
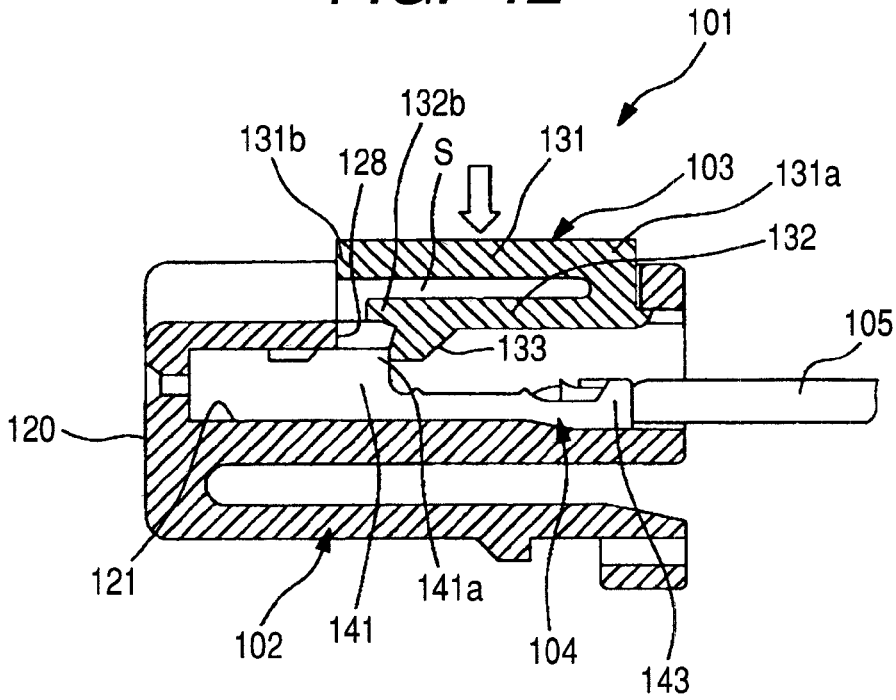
FIG. 12 is a cross-sectional view of a conventional connector including a retainer and a connector housing, showing a condition in which the retainer is provisionally retained relative to the connector housing, and a metal terminal is provisionally held in the connector housing.
Figure 13:
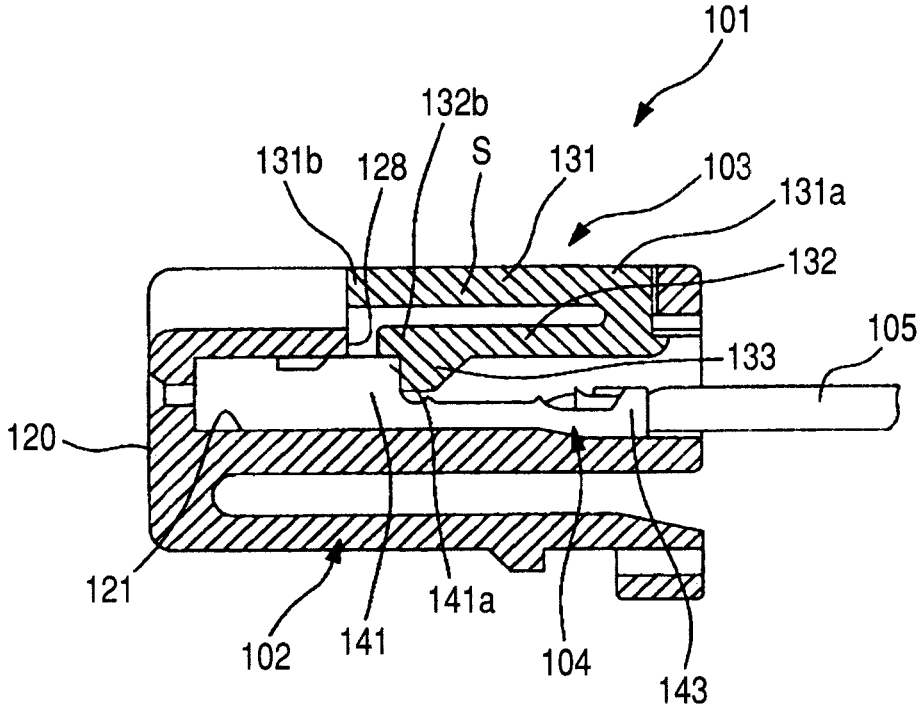
FIG. 13 is a cross-sectional view of the connector of FIG. 12, showing a condition in which the retainer is completely retained relative to the connector housing, and the metal terminal is completely held in the connector housing.
Figure 14:
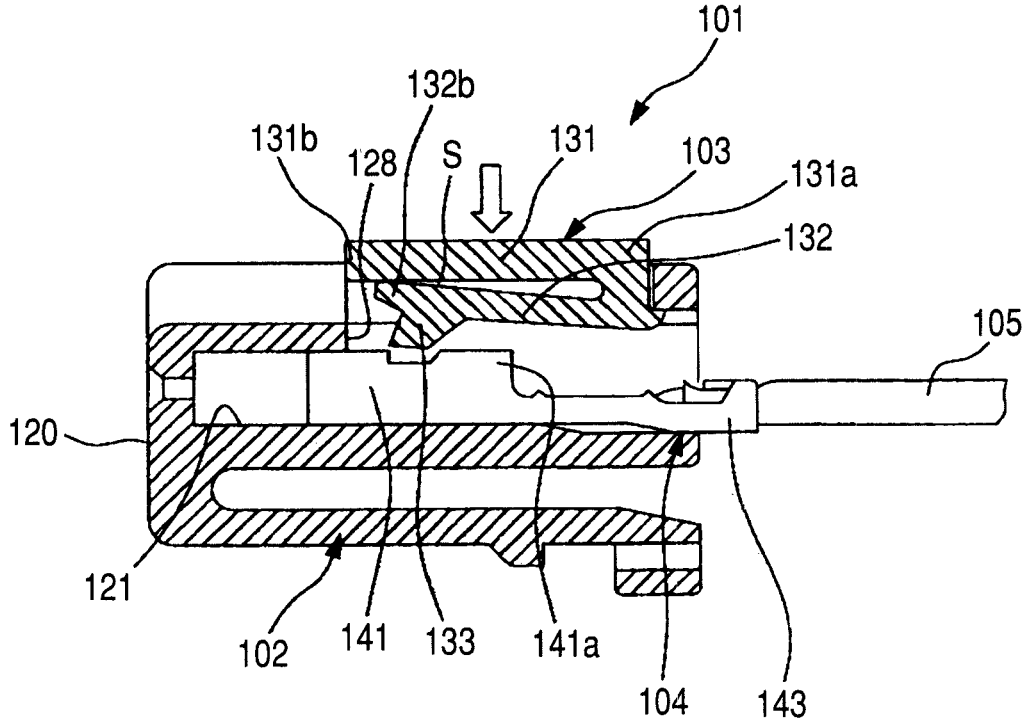
FIG. 14 is a cross-sectional view of the connector of FIG. 12, showing a condition in which the metal terminal is half inserted in the connector housing.

In the present invention, the expression "the lance 6 is retainingly engaged with the metal terminal 4" means that the other end portion of the lance 6 abuts against irregularities on the surface of the metal terminal 4. The expression "the metal terminal 4 is located in the proper position within the terminal receiving space 21" means the condition shown in FIG. 9, and in this condition the electrical contact portion 41 of the metal terminal 4 is completely inserted to fit even in the other end portion 21*b* of the terminal receiving space 21 in the fitting direction Z. When the electrical contact portion 41 is merely inserted short of the other end portion 21*b* as shown in FIG. 11, this condition is expressed as "a condition in which the metal terminal 4 is half inserted in the terminal receiving space 21".

Figure 2:
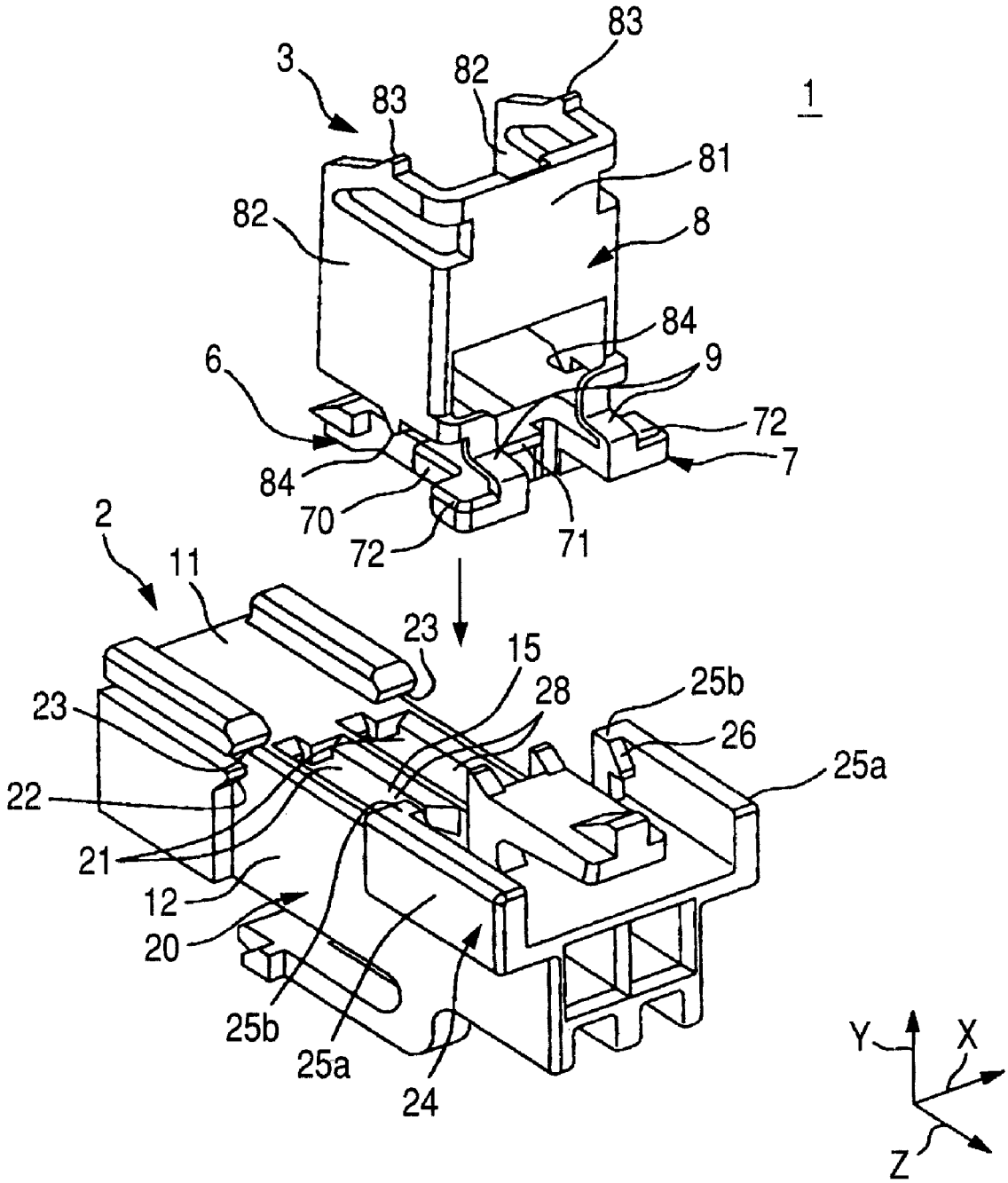
FIG. 2 is a view similar to FIG. 1, but showing the connector as seen from a different direction.

As shown in FIG. 2, the pair of hinges 9 are connected at their one ends respectively to opposite end portions of the U-shaped portion 70 and also are connected at the other end portions to an abutment wall portion 81 of the lance abutment portion 8 (described later). Namely, the base portion 7, the pair of lances 6, the pair of hinges 9 and the lance abutment portion 8 are formed integrally with one another, that is, are molded into an integral construction. The hinges 9 are smaller in thickness than the U-shaped portion 70 and the abutment wall portion 81, and can be easily bent.

The lance abutment portion 8 includes the flat plate-like abutment wall portion 81 connected to the pair of hinges 9, a pair of flat plate-like upstanding wall portions 82 extending perpendicularly respectively from opposite side edges of the abutment wall portion 81 in parallel opposed relation to each other, the pair of first retaining projections 83 formed respectively on outer edges of the pair of upstanding wall portions 82, and a pair of second retaining projections 84 formed respectively on outer edges of the pair of upstanding wall portions 82.

The lance abutment portion 8 can be pivotally moved about an axis on which the pair of second retaining projections 84 lie, and therefore can be moved or displaced from an open position (see FIG. 3) where the opening portions 28 are not closed by the abutment wall portion 81 through a provisionally-retaining position (see FIGS. 4, 5 and 8) where the abutment wall portion 81 half closes the opening portions 28 in spaced relation to the lances 6, and is provisionally retained relative to the connector housing 2 to a completely-retaining position (see FIGS. 6, 7 and 10) where the abutment wall portion 81 closes the opening portions 28 in abutting relation to the lances 6, and is completely retained relative to the connector housing 2.

Figure 5:
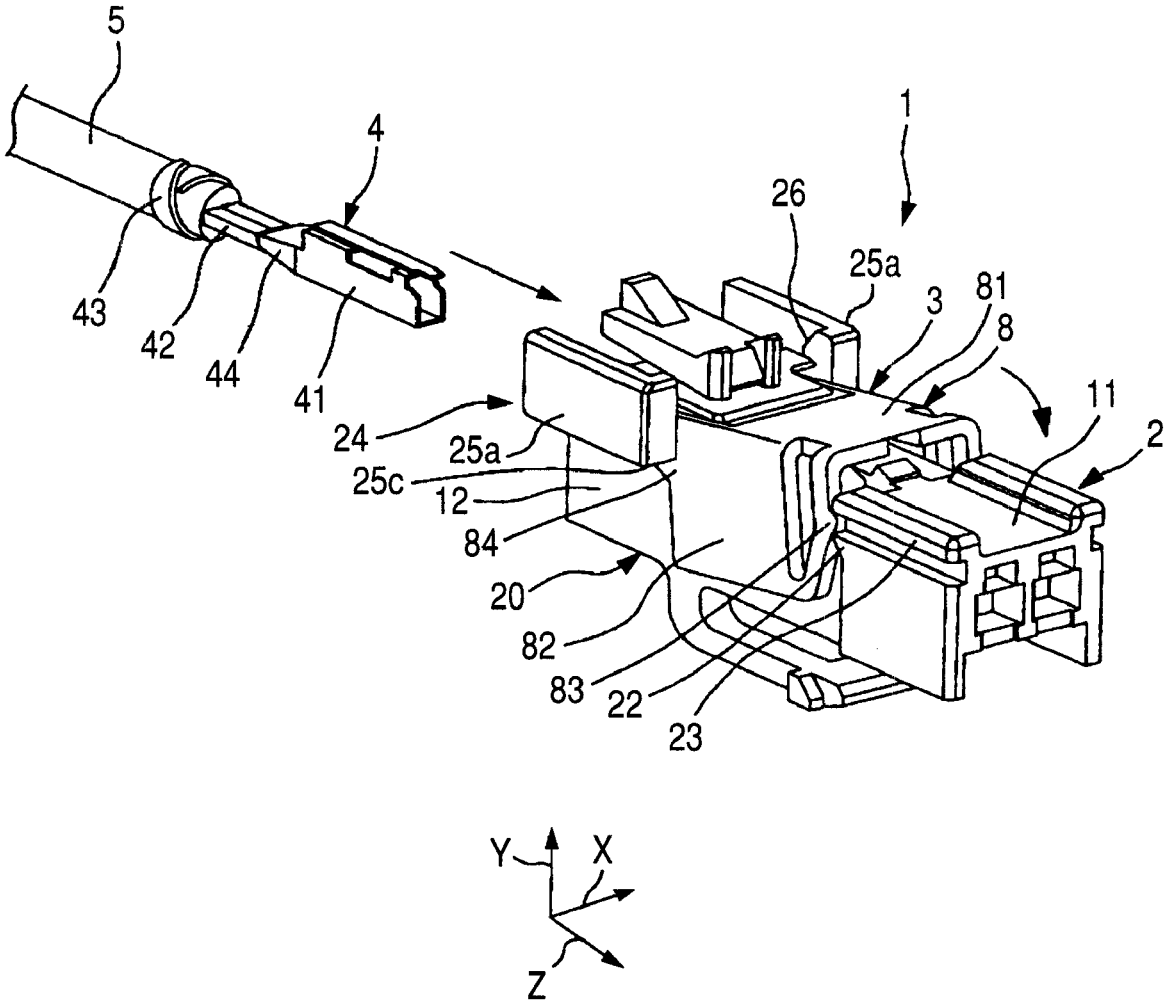
FIG. 5 is a view similar to FIG. 4, but showing the connector as seen from a different direction.
Figure 7:
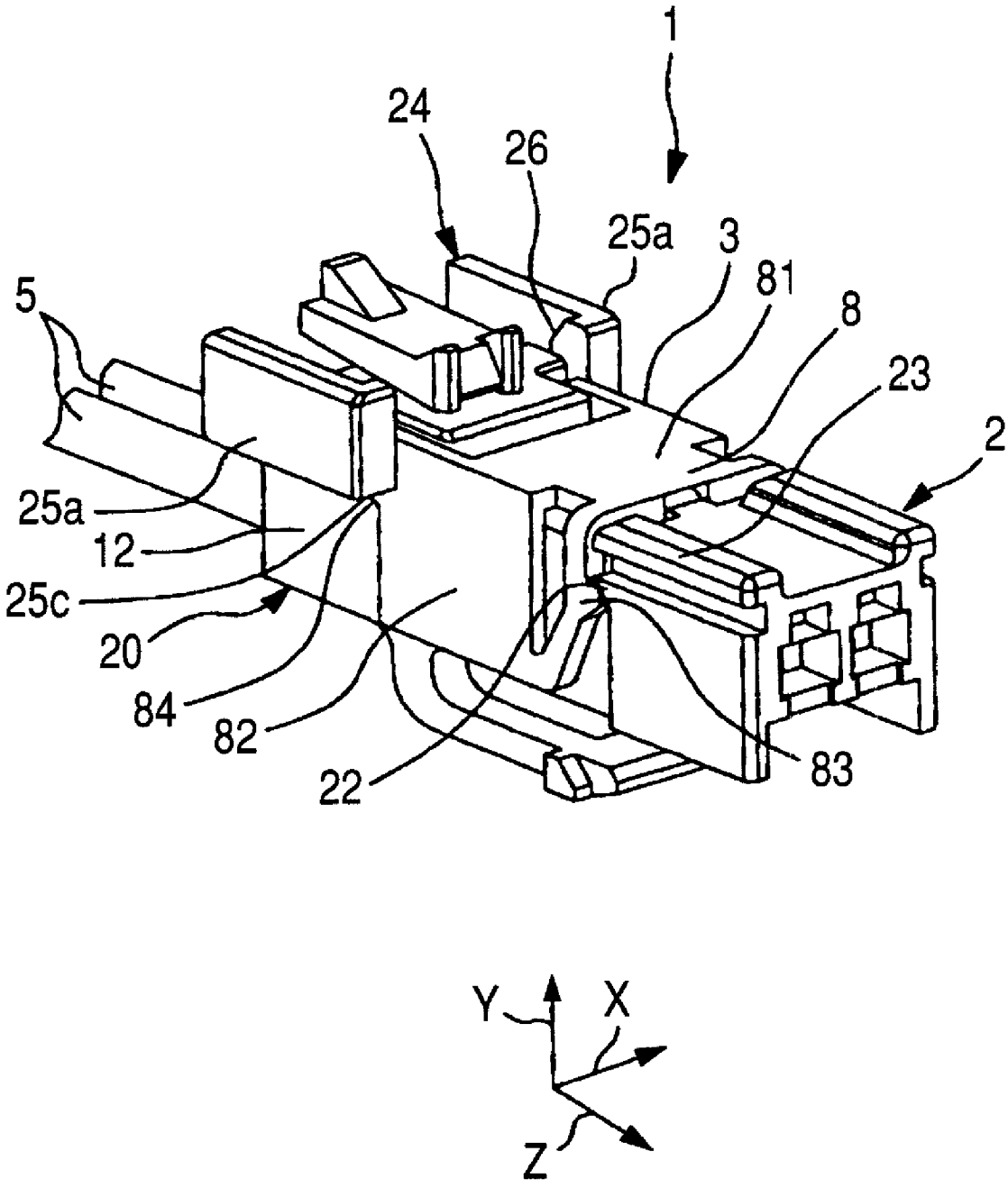
FIG. 7 is a view similar to FIG. 6, but showing the connector as seen from a different direction.
Figure 8:
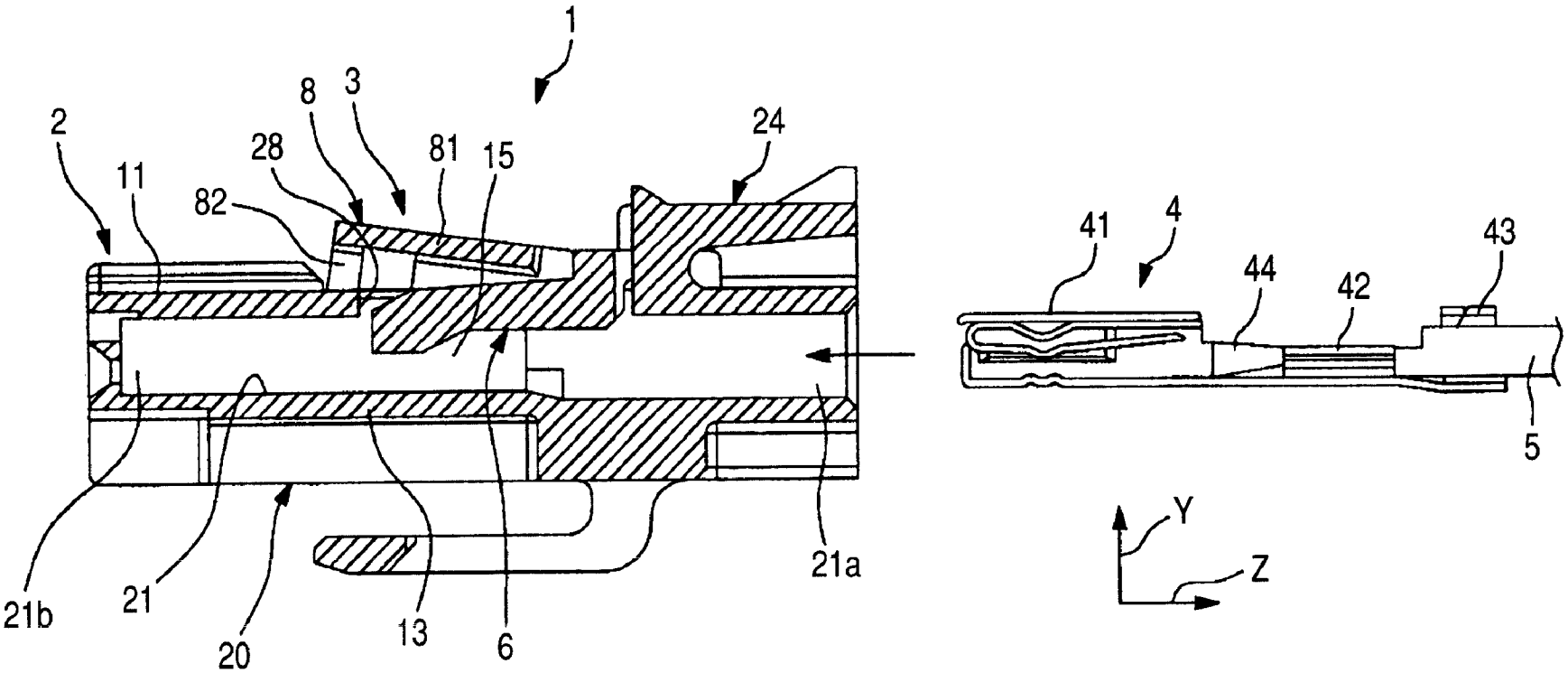
FIG. 8 is a cross-sectional view taken along the line A-A of FIG. 4.

In the provisionally-retained condition of the lance abutment portion 8 shown in FIGS. 4, 5 and 8, the second retaining projections 84 are retainingly engaged respectively with lower corner portions 25*c* of the upstanding walls 25*a* disposed near to the opening portions 28, while the first retaining projections 83 are retainingly engaged with the provisionally-retaining portions 23, respectively. In the completely-retained condition of the lance abutment portion 8 shown in FIGS. 6, 7 and 10, the second retaining projections 84 remain retainingly engaged respectively with lower corner portions 25*c* of the upstanding walls 25*a* disposed near to the opening portions 28, while the first retaining projections 83 are retainingly engaged with the retaining portions 22, respectively.

Next, the manner of assembling the connector 1 of the above construction will be described.

Figure 3:
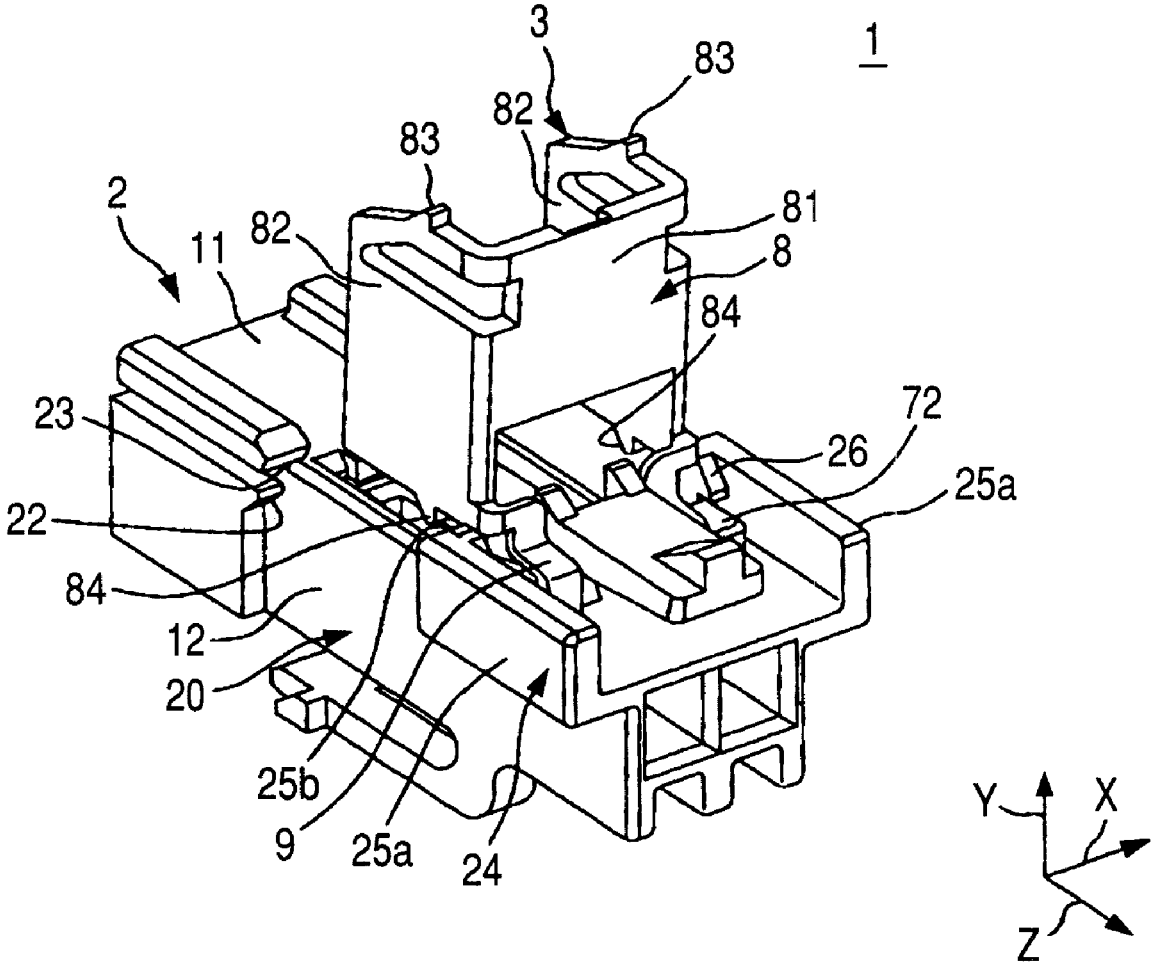
FIG. 3 is a perspective view of the connector of FIG. 1, showing a condition in which the retainer is attached to the connector housing.

First, the retainer 3 is attached to the connector housing 2 in which the metal terminals 4 have not yet been inserted, as shown in FIGS. 1 and 2. For attaching the retainer 3, the retainer 3 is moved toward the connector housing 2 from the upper side in the direction Y of the height, and the base portion 7 is press-fitted to the retainer mounting portion 24. FIG. 3 shows a condition in which the retainer 3 is attached to the connector housing 2.

Then, the lance abutment portion 8 of the retainer 3 shown in FIG. 3 is turned toward the upper wall 11, and first, the second retaining projections 84 are retainingly engaged respectively with the corner portions 25*c*, and then the lance abutment portion 8 is pivotally moved about the axis on which the pair of second retaining projections 84 lie, thereby bringing the first retaining projections 83 into retaining engagement with the provisionally-retaining portions 23, respectively. Thus, the retainer 3 is provisionally retained relative to the connector housing 2 as shown in FIGS. 4, 5 and 8. In this condition, the lances 6 are spaced from the abutment wall portion 81. Also, the lances 6 passed through the respective opening portions 28 are located within the respective terminal receiving spaces 21.

Then, in the condition shown in FIGS. 4, 5 and 8, the metal terminals 4 are inserted respectively into the terminal receiving spaces 21 of the connector housing 2 in the fitting direction Z. When each metal terminal 4 passes under the corresponding lance 6, its electrical contact portion 41 elastically deforms the lance 6 upwardly (see FIG. 11). At this time, the lance 6 can be elastically deformed upwardly, that is, toward the abutment wall portion 81, since the lance 6 and the abutment wall portion 81 are spaced from each other as described above.

Figure 9:
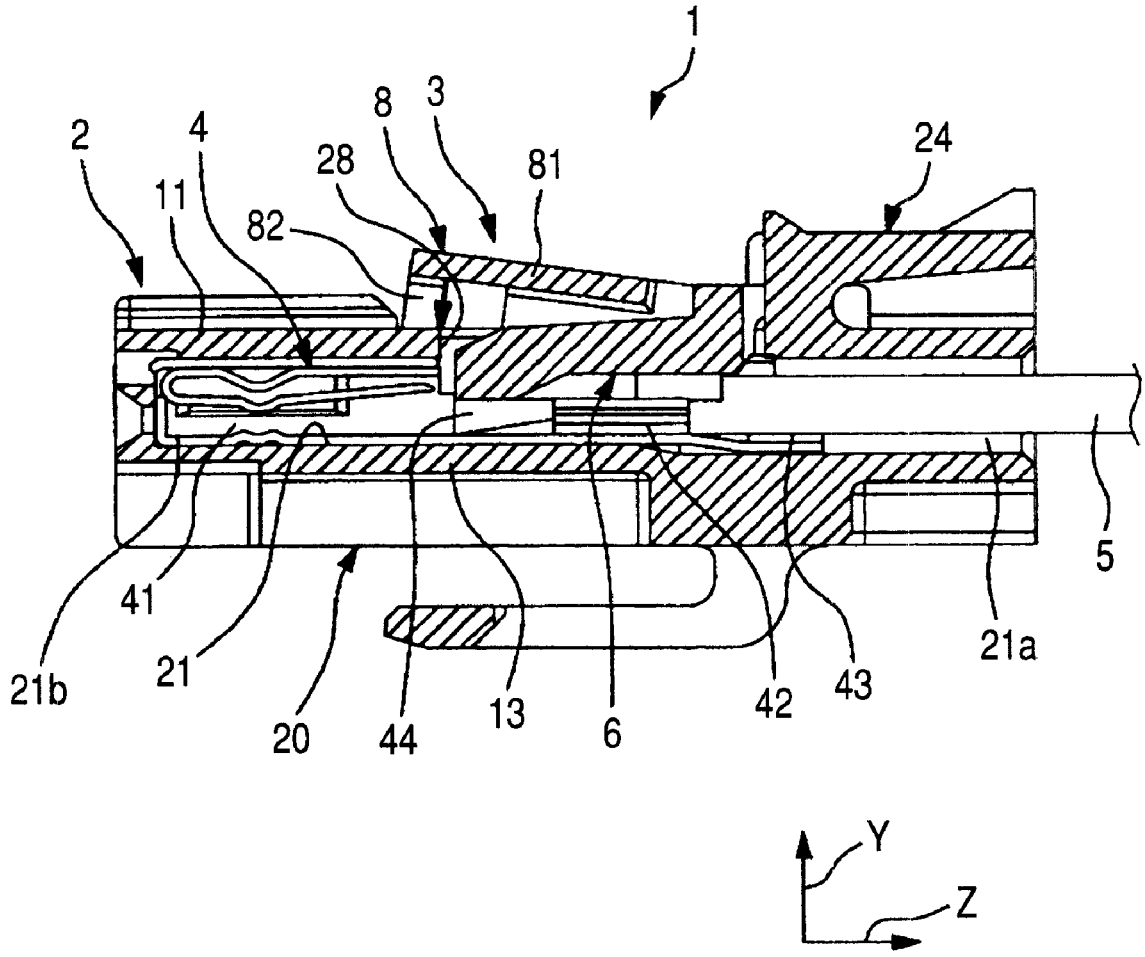
FIG. 9 is a cross-sectional view of the connector, but showing a condition in which the metal terminals are inserted in the connector housing of FIG. 8, and the lance abutment portion of the retainer is provisionally retained relative to the connector housing.

Then, when each metal terminal 4 is inserted into the proper position within the terminal receiving space 21, that is, into the other end portion 21*b*, the upwardly elastically-deformed lance 6 is restored into its original position, so that the other end portion of the lance 6 abut against the interconnecting portion 44 of the metal terminal 4 as shown in FIG. 9. Namely, the lance 6 is retainingly engaged with the metal terminal 4. Therefore, the metal terminal 4 is prevented from withdrawal from the terminal receiving space 21.

Figure 10:
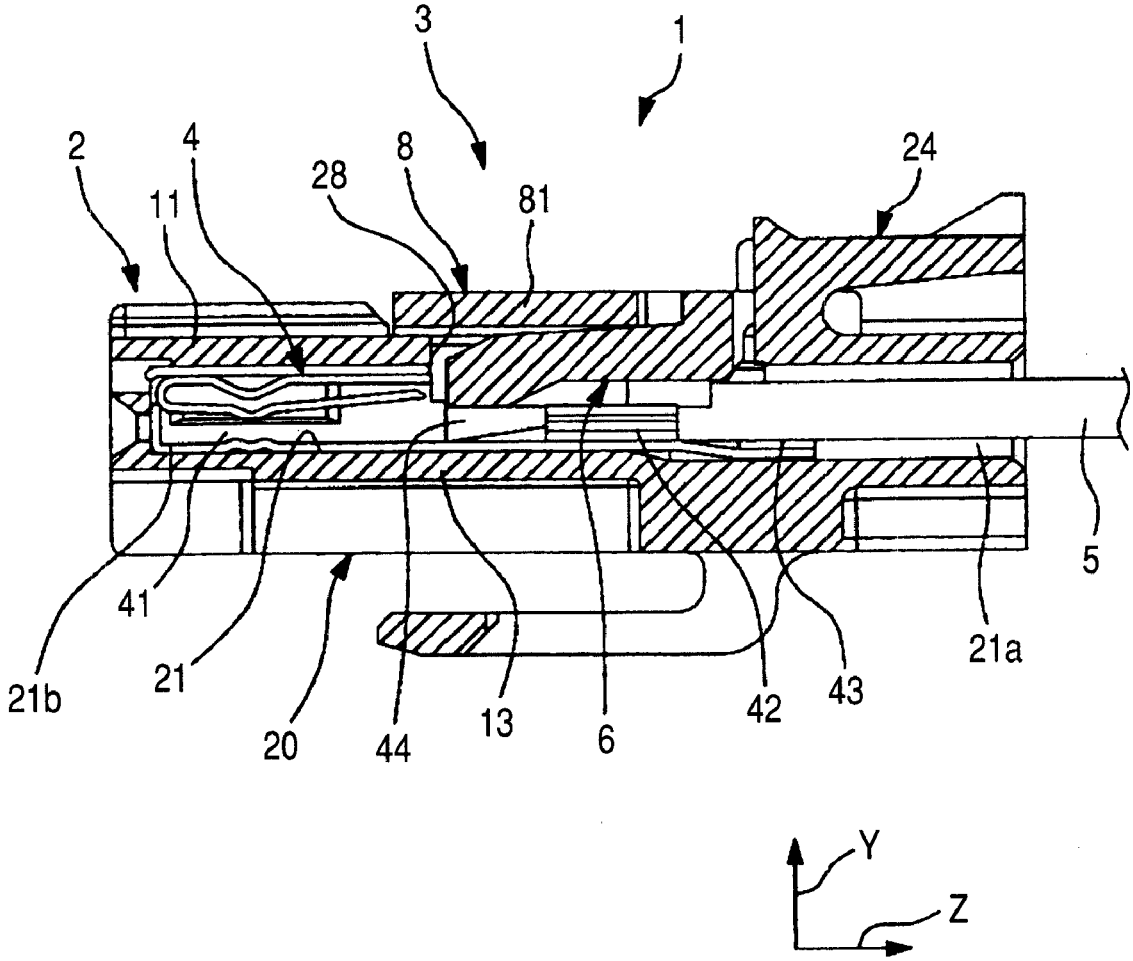
FIG. 10 is a cross-sectional view taken along the line B-B of FIG. 6.

In the invention, each lance 6 is provided such that the amount of insertion of the lance 6 in the terminal receiving space 21 before the lance 6 is retainingly engaged with the metal terminal 4 (as shown in FIG. 8), the amount of insertion of the lance 6 in the terminal receiving space 21 when the lance 6 is retainingly engaged with the metal terminal 9 (as shown in FIG. 9), and the amount of insertion of the lance 6 when the abutment wall portion 81 abuts against the lance 6 (as shown in FIG. 10) are the same. Therefore, the amount of engagement of the lance 6 with the metal terminal 4, that is, a retaining force by which the lance 6 retains or holds the metal terminal 4 within the terminal receiving space 21, is always constant, and therefore the metal terminal 4 is positively prevented from withdrawal from the connector housing 2. Furthermore, in the invention since the amount of insertion of the lance 6 is always constant as described above, an insertion feeling (a reaction force of the lance 6), obtained when the metal terminal 4 is inserted into the proper position within the terminal receiving space 21, can be made large, and therefore the metal terminal 4 is prevented from being kept in a half-inserted condition (in which the metal terminal 4 is not inserted into the proper position).

Figure 6:
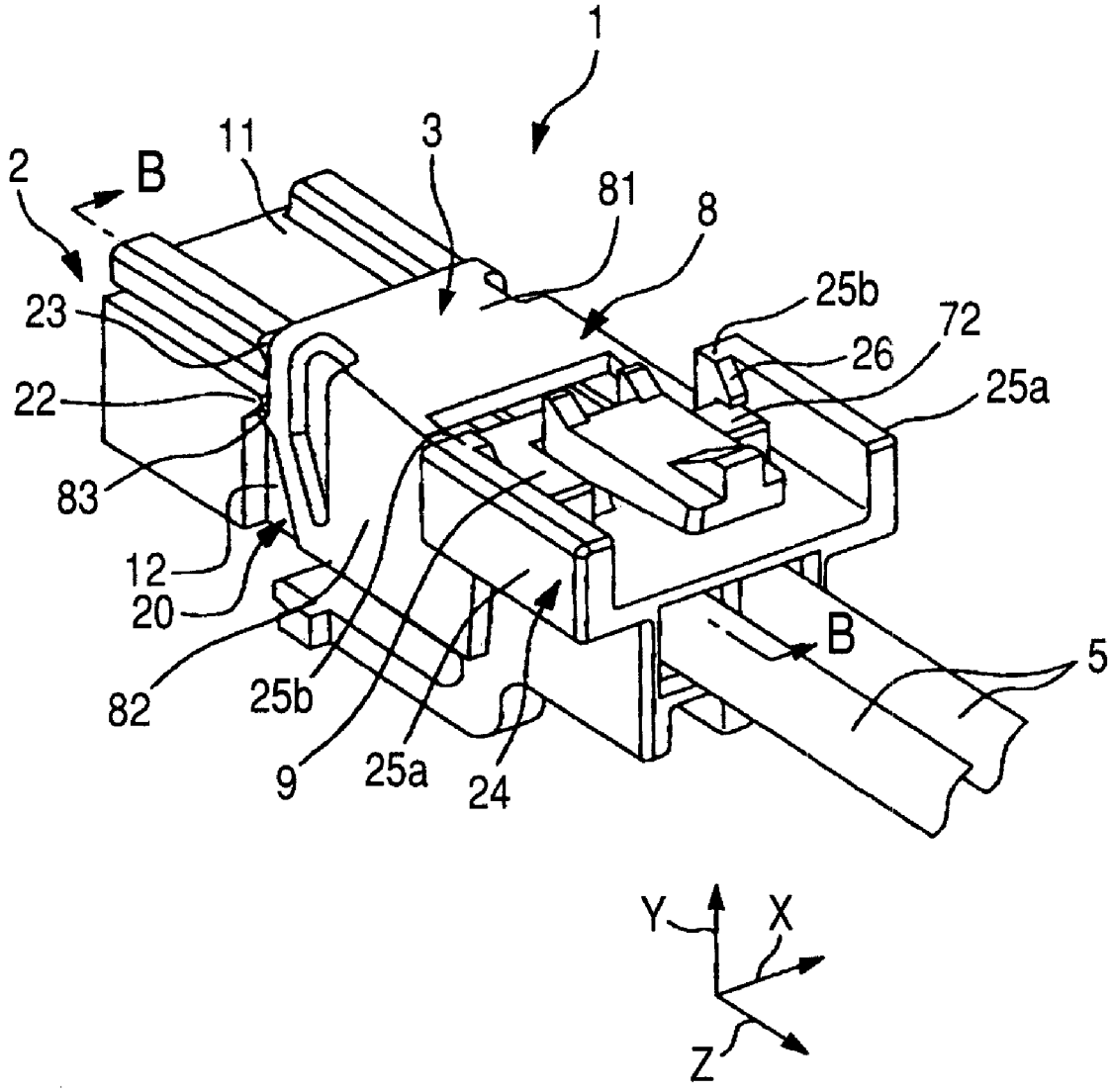
FIG. 6 is a perspective view of the connector, showing a condition in which metal terminals are inserted in the connector housing of FIG. 4, and the lance abutment portion of the retainer is completely retained relative to the connector housing.

Then, the lance abutment portion 8 is further pivotally moved toward the upper wall 11 about the axis on which the pair of second retaining projections 84 lie, thereby bringing the first retaining projections 83 into retaining engagement with the retaining portions 22, respectively. Thus, the lance abutment portion 8 is completely retained relative to the connector housing 2 as shown in FIGS. 6, 7 and 10. In this condition, the abutment wall portion 81 abuts against the lances 6, that is, is held in surface-to-surface contact with the lances 6, to prevent the lances 6 from being elastically deformed upwardly. Namely, the lance abutment portion 8 holds each lance 6 in retainingly-engaged relation to the corresponding metal terminal 4, thus preventing the retaining engagement of the lance 6 with the metal terminal 4 from being canceled. The connector 1 is assembled in this manner.

When the metal terminal 4 is not located in the proper position within the terminal receiving space 21, that is, the metal terminal 4 is half inserted, the other end portion of the lance 6 slides onto the electrical contact portion 41, and therefore is elastically deformed upwardly to project outwardly from the terminal receiving space 21 as shown in FIG. 11. Therefore, the abutment wall portion 81 strikes against this projected lance 6, and therefore the first retaining projections 83 can not be brought into retaining engagement with the respective retaining portions 22. This half-inserted condition of the metal terminal 4 is detected from the fact that the lance abutment portion 8 thus cannot be located in the completely-retained position. Therefore, the metal terminal 4 can be positively prevented from being kept in such a half-inserted condition.

In this embodiment, with the above construction, the metal terminal 4 can be positively prevented from withdrawal from the terminal receiving space 21 of the connector housing 2. And besides, when the first retaining projections 83 can not be brought into retaining engagement with the respective retaining portions 22, a half-inserted condition of the metal terminal 4 can be detected from this fact, and with this construction the metal terminal 4 can be positively prevented from being kept in such a half-inserted condition.

Furthermore, the lances 6 and the lance abutment portion 8 are interconnected by the hinges 9 and the base portion 7 such that these portions are molded into an integral construction. Therefore, the number of the component parts of the connector 1, as well as the number of molds for producing the connector 1, can be reduced, and therefore the cost of management for the component parts of the connector 1, as well as the cost of management for the molds for producing the connector 1, can be reduced. Furthermore, the efficiency of the operation for assembling the connector 1 is enhanced, and therefore a cost required for assembling the connector 1 can be reduced.

Furthermore, the connector housing 2 has the provisionally-retaining portions 23 with which the lance abutment portion 8 spaced from the lances 6 can be retainingly engaged, and therefore the connector 1 can be carried and stored, with the lance abutment portion 8 kept provisionally retained relative to the connector housing 2.

In the above embodiment, the lances 6 and the lance abutment portion 8 are interconnected by the hinges 9 and the base portion 7 such that these portions are molded into an integral construction. However, in the invention, the lances 6 may be separate from the lance abutment portion 8.

The above embodiment merely shows a representative example of the present invention, and the invention is not limited to the above embodiment. Namely, various modifications can be made without departing from the subject matter of the invention.

What is claimed is:

1. A connector, comprising:

a connector housing having a terminal receiving space for receiving a metal terminal, and a retainer for preventing withdrawal of the metal terminal from the terminal receiving space;

wherein said retainer includes:

a lance inserted into said terminal receiving space through an opening portion formed through an outer wall of said connector housing, and retainingly engaged with said metal terminal located in a proper position within said terminal receiving space so as to prevent withdrawal of said metal terminal from said terminal receiving space; and a lance abutment portion abutting against said lance retainingly engaged with said metal terminal, and retainingly engaged with a retaining portion formed at said connector housing so as to hold said lance in retainingly-engaged relation to said metal terminal; and wherein said lance is provided such that the amount of insertion of said lance in said terminal receiving space before said lance is retainingly engaged with said metal terminal is equal to the amount of insertion of said lance in said terminal receiving space when said lance is retainingly engaged with said metal terminal; and when said metal terminal is kept half inserted in said terminal receiving space, said lance is located outwardly of said terminal receiving space, so that said lance prevents said lance abutment portion from being retainingly engaged with said retaining portion, thereby detecting the fact that said metal terminal is half inserted in said terminal receiving space.

2. The connector according to claim 1, wherein said lance and said lance abutment portion are interconnected by a hinge.

3. The connector according to claim 1, wherein said lance abutment portion is so provided as to be displaced between a position where said lance abutment portion is spaced from said lance and a position where said lance abutment portion abuts against said lance; and said connector housing has a provisionally-retaining portion with which said lance abutment portion spaced from said lance can be retainingly engaged.

* * * * *